US006220137B1

(12) United States Patent
Matsuoka

(10) Patent No.: US 6,220,137 B1
(45) **Date of Patent: *Apr. 24, 2001**

(54) PRESS APPARATUS

(75) Inventor: Mitsuo Matsuoka, Hirakata (JP)

(73) Assignee: Umix Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/233,466

(22) Filed: Jan. 20, 1999

(51) Int. Cl.[7] ..... B26D 5/08; B26D 5/00; B21J 9/18

(52) U.S. Cl. ..... 83/627; 83/635; 83/821; 83/588; 72/452.9

(58) Field of Search ..... 83/197, 582, 638, 83/627, 635, 821, 139, 588, 620, 828, 829; 72/315, 452.9

(56) References Cited

U.S. PATENT DOCUMENTS 3,815,459 * 6/1974 Daniels ..... 83/140
3,858,427 * 1/1975 Euteneuer et al. ..... 83/627
4,621,512 * 11/1986 Tachikawa et al. ..... 83/623 X
5,101,705 * 4/1992 Matsuoka ..... 83/627
5,231,907 * 8/1993 Matsuoka ..... 83/635
5,487,296 * 1/1996 Gerhart et al. ..... 83/635
5,678,468 * 10/1997 Lozano Bonet et al. ..... 83/627
5,711,180 * 1/1998 Sasahara et al. ..... 72/452.9
5,881,599 * 3/1999 Sasahara et al. ..... 72/452.9
5,884,521 * 3/1999 Fidziukiewicz ..... 83/635
5,904,064 * 5/1999 Higuchi ..... 83/635

* cited by examiner

*Primary Examiner*—S. Thomas Hughes
*Assistant Examiner*—Marc Jimenez
(74) *Attorney, Agent, or Firm*—Birch, Stewart, Kolasch & Birch, LLP

(57) ABSTRACT

A press apparatus includes a passive cam to which a processing member such as a punch is mounted. Removal of the passive cam from a lower die for repair is made to be easy, and workability is improved. The press apparatus has an actuation cam in an upper die, a passive cam in a lower die which is contact-pressed and driven by the actuation cam, a guide base in the lower die for sliding and guiding the passive cam, guide posts which are mounted across the guide base and move so as to slide the passive cam, and a force applying device for applying a force to the passive cam towards an opposite-work side. In such a press apparatus, the passive cam is fitted onto the guide base so that when the guide posts which are mounted across the guide base are removed, the passive cam can be lifted up and dismounted.

20 Claims, 7 Drawing Sheets

PRESS APPARATUS

BACKGROUND OF THE INVENTION

1. Field of the Invention

The present invention relates to a press apparatus. More specifically, the present invention relates to a press apparatus which makes it easy to remove a passive cam from the a lower die so as to improve workability. Moreover, the present invention relates to a press apparatus which is constituted so that a guide post is mounted across the nearest vicinity of a portion of the passive cam to which a processing member such as a punch is mounted, and is positioned on both sides of the processing member, and which can improve processing accuracy of a cam die as much as possible.

2. Description of the Background Art

A normal press apparatus is constituted so that a lower die is mounted to a bed of a press machine and a an upper die is mounted to a ram, and when the upper die is lifted and lowered, boring and forming processes are performed. Since the upper die is lifted and lowered in the vertical direction, the process in the lateral direction is performed in such a manner that the processing force in the vertical direction is converted into the processing force in the lateral direction by using a cam member.

The description will be given as to an example where a hole is bored in a side wall of a work by using the press apparatus having the cam member.

As shown in FIGS. 6 and 7, a locating member 104 for locating a work 103 is projected from a lower die 101. A passive cam 107 having a punch 106 is provided on a position which faces a blanked hole 105 in a side wall of the work 103 so as to slide. A heel 108 is fixed to a rear portion of the passive cam 107. A coil spring 109 is fitted into the passive cam 107 so as to be externally fitted in a point of a rod 110 through which the heel 108 is put. One end of the coil spring 109 is brought into contact with the heel 108, and a nut 112 is fitted to the other end of the coil spring 109 via a washer 111. As a result, the coil spring 109 pulls the passive cam 107 in which the hole was provided back to the work 103. An actuation cam 118 is projected from the upper die 116 so as to be in a position which faces the passive cam 107.

The upper die 116 is lowered and the actuation cam 118 advances the passive cam 107 against the applied force of the coil spring 109, and a hole 105 is bored into the work 103 by the punch 106 and a die 125. When the upper die 116 is lifted, the passive cam 107 is brought back by the applied force of the coil spring 109.

Since the hole is bored in the side wall of the work 103, as mentioned above, the passive cam 107 having the punch 106 approaches and separates from the work 103 so as to slide on the lower die 101. Since the hole is bored by the punch 106 and the die 125, the passive cam 107 must slide exactly. A flange 121 is projected from both sides of the lower part of the passive cam 107, and a sidewise guide plate 122 and an upper guide plate 123 for guiding the flange 121 are fixed to the lower die 101. A reference numeral 124 is a wear plate.

Since a processing member such as the punch 106 is mounted to the passive cam 107, there occasionally arises a problem that a cutting edge of the punch 106 is nicked during the processing and thus it should be repaired. In the mounted state shown in FIG. 7, since the repair is impossible, the passive cam 107 should be removed from the lower die 101. The heel 108 is removed and the passive cam 107 is guided by the sidewise guide plate 122 and the upper guide plate 123 so as to be moved towards the opposite-work side (backward). Thereafter, the passive cam 107 is passed through the sidewise guide plate 122 and the upper guide plate 123 so as to be removed from the lower die 101. Therefore, it takes a long time to remove the passive cam 107 from the lower die 101, and thus repairing workability is not good.

In addition, while the passive cam 107 slides repeatedly, it is worn out, and thus a gap is generated between the passive cam 107 and the sidewise guide plate 122. As a result, the passive cam 107 cannot slide in the straight linear direction, and it slides non-linearly due to the gap. Since the punch 106 mounted to the passive cam 107 also slide non-linearly, the punch 106 cannot blank the die 125 in its whole periphery with a suitable clearance. As a result, burr occurs on the periphery of the blanked hole, and a high-quality boring process cannot be performed. Moreover, since the punch 106 and the die 125 carried out the blanking with burr, the gap causes the cutting edges of the punch 106 and the die 125 to be nicked. In order to attain the high-quality pressing process, the passive cam 107 should be moved straight and exactly without non-linear movement.

Further, since inclined weight due to the forming process is placed on the passive cam, the passive cam is apt to shift. Therefore, this shift is eliminated, and thus a product should be processed into a desired shape.

Furthermore, it is necessary to improve processing accuracy of a cam die as much as possible.

SUMMARY OF THE INVENTION

Accordingly, the present invention is devised in such points in view. In order to easily remove a passive cam from a lower die when the passive cam to which a processing member such as a punch was mounted to be repaired, the present invention provides a press apparatus having an actuation cam in an upper die, a passive cam in a lower die which is contact-pressed and driven by the actuation cam and to which a processing member such as a punch is mounted, a guide base in the lower die for sliding and guiding the passive cam, guide posts which are mounted across the guide base and move so as to slide the passive cam, and force applying means for applying a force to the passive cam towards an opposite-work side. In such a press apparatus, the passive cam is fitted onto the guide base so that when the guide posts mounted across the guide base are drawn out, the passive cam is lifted up and dismounted.

In addition, according to the present invention, the passive cam advances straight and moves along the guide posts in order to attain a high-quality pressing process.

Further, according to the present invention, the passive cam is externally fitted onto the guide base in order to lift and dismount the passive cam.

Furthermore, according to the present invention, inclined weight is placed on the passive cam due to the forming process or the like, and thus the passive cam is apt to shift. In order to eliminate this shift and to process a product into a desired shape, the sliding surface of the passive cam and the guide base has a vertical surface.

In addition, in order to improve processing accuracy using a cam die as much as possible, the guide posts are mounted across the nearest vicinity of a portion of the passive cam where the processing member such as the punch is mounted and are positioned on both sides of the processing member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

There will be detailed below the preferred embodiments of the present invention with reference to the drawings.

The present embodiment refers to an example wherein a hole is bored in a work.

Figure 1:
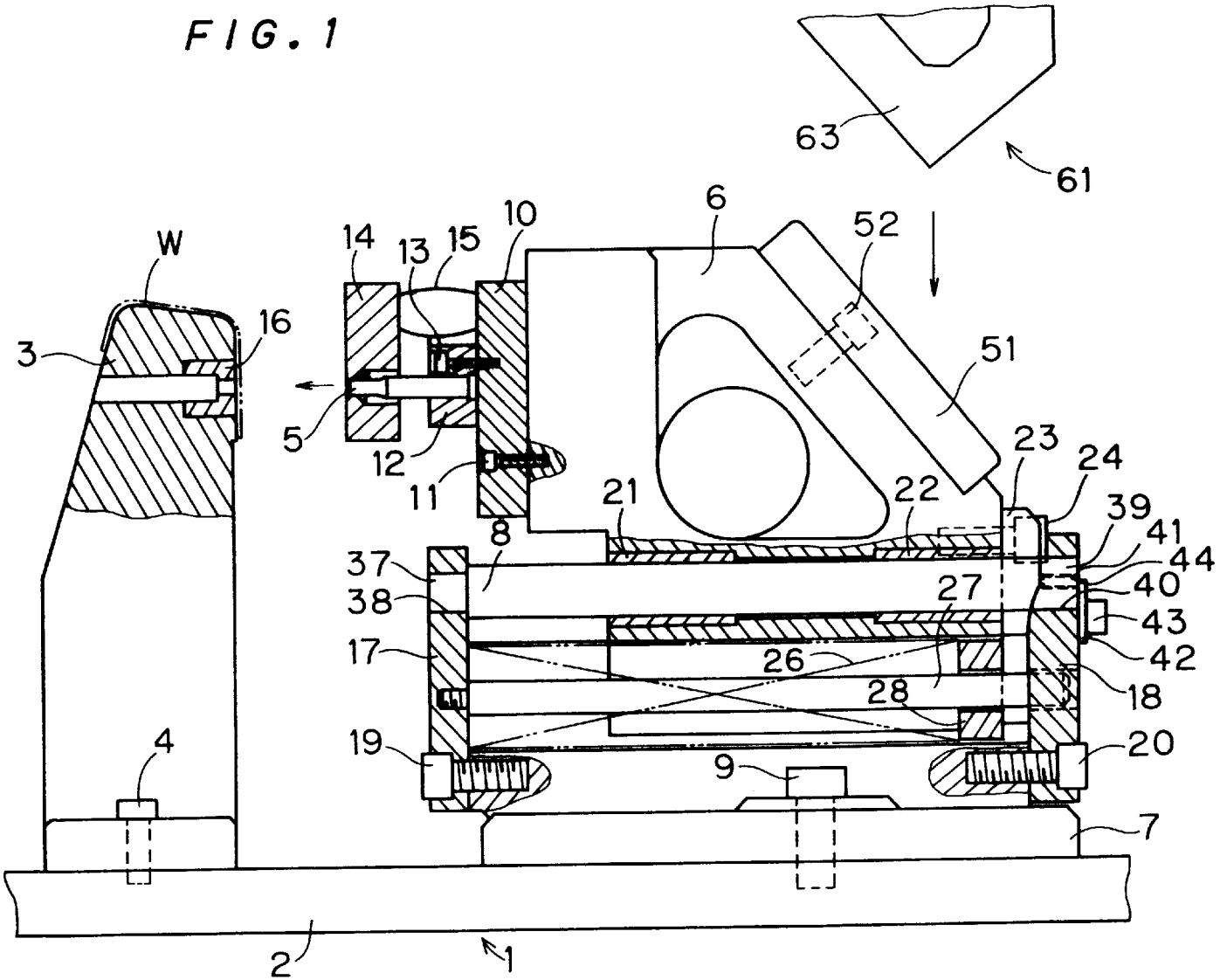
FIG. 1 is a side view showing a press apparatus according to a preferred embodiment of the present invention and showing a cross section of one portion of an upper die in a lowering state.
Figure 2:
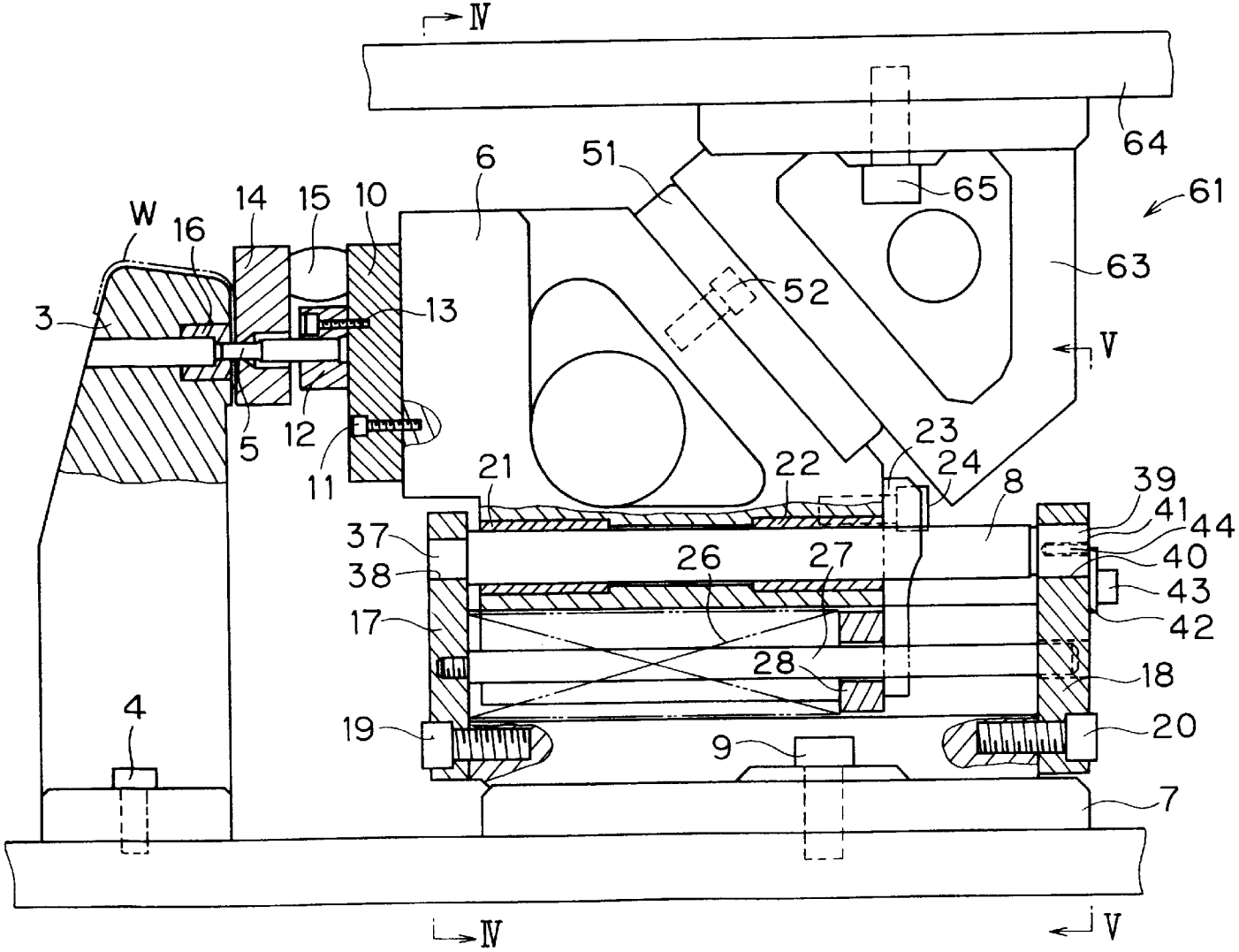
FIG. 2 is a side view showing a cross section of one portion in a bottom dead center position.

As shown in FIGS. 1 and 2, a locating member 3 for locating a work W is fixed onto a substrate 2 in a lower die 1 by a bolt 4.

A passive cam 6 for mounting a boring punch 5 for boring the work W is positioned so as to face the work W. The passive cam 6 is provided onto guide posts 8 which are mounted across a guide base 7 so as to slide, and the guide base 7 is fixed to the substrate 2 by a bolt 9.

A mounting plate 10 is fixed to a work processing side of the passive cam 6 by a bolt 11. A punch plate 12 is fitted into the mounting plate 10 by a bolt 13 so that the boring punch 5 is mounted. A force is applied to a stripper plate 14 by a cushion rubber 15, and the stripper plate 14 presses the work W before a hole is bored in the work W. A reference numeral 16 is a die which is fitted to the boring punch 5 and carries out piercing.

Supporting plates 17 and 18 are fittingly jointed with the forward and rearward ends of the guide base 7 by bolts 19 and 20. Here, a side which is close to the work W is referred to as forward, and a side which is far from the work W is referred to as rearward. The guide posts 8 are mounted across the supporting plates 17 and 18 horizontally, and bushes 21 and 22 are pressed into the passive cam 6 and externally fitted onto the guide posts 8 so that the passive cam 6 slidable on the guide posts 8. A length of the passive cam 6 between the supporting plates 17 and 18 is set so as to be shorter than a distance between the supporting plates 17 and 18. This is because the passive cam 6 can move in the lateral direction.

Figure 3:
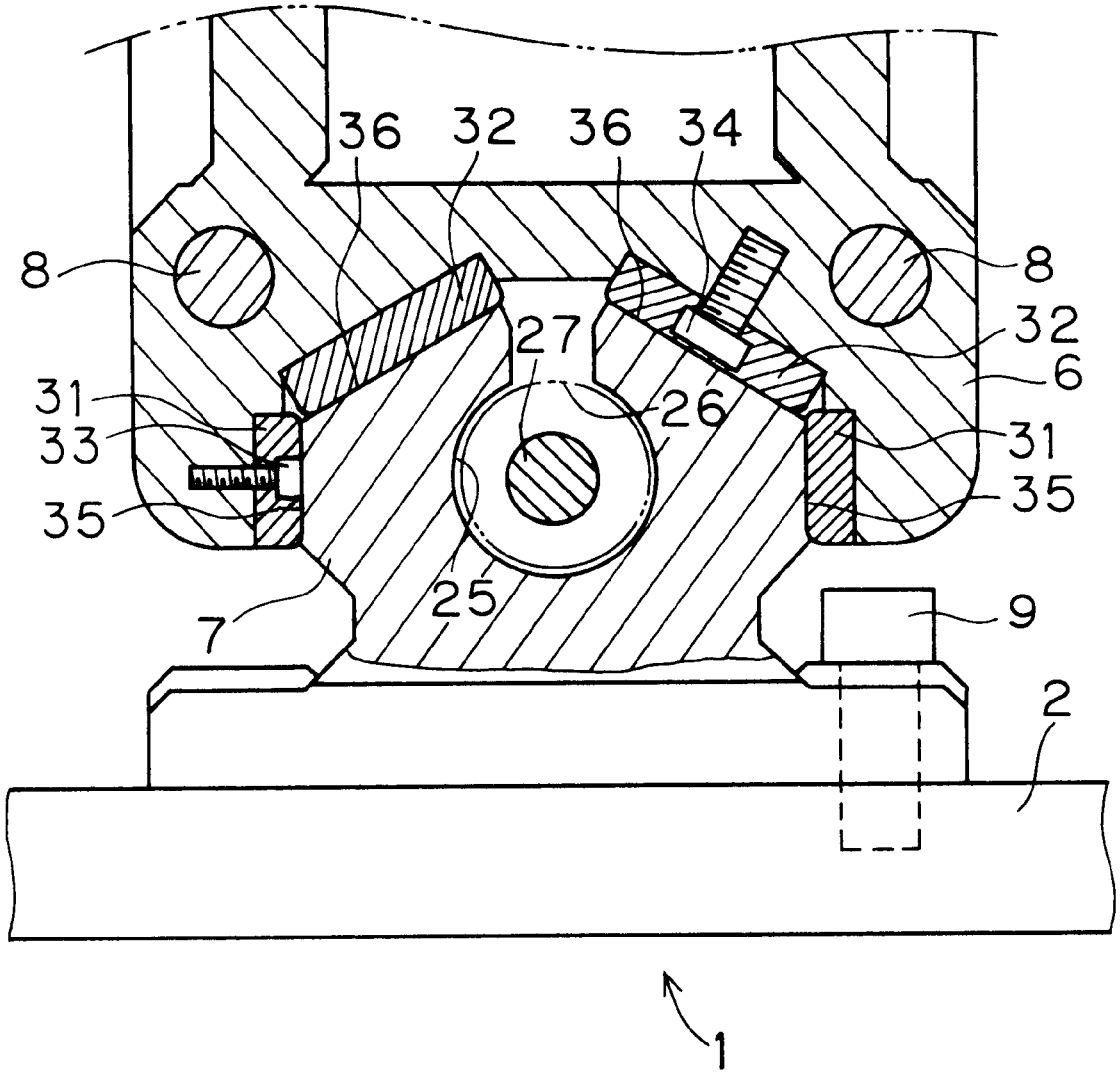
FIG. 3 is a sectional view of a middle portion of FIG. 2.

The guide posts 8 are brought to the boring punch 5 as close as possible in order to improve boring accuracy using the boring punch 5. Moreover, the guide posts 8 are positioned respectively on both sides of the boring punch 5, namely, both sides of the boring punch 5 in the horizontal direction, as shown in FIG. 3. Since the passive cam 6 is guided by the guide posts 8 so as to slide and the boring punch 5 is fixed to the passive cam 6, as the boring punch 5 is closer to the guide posts 8, it moves more accurately. Therefore, accurate processing can be carried out. When the guide posts 8 are positioned respectively on both the sides of the boring punch 5, the boring punch 5 can be held in more accurate and exact position compared with the case that only one guide post 8 is fitted into the passive cam 6, and thus accurate processing can be carried out.

A receiving plate 23 is positioned vertically on a rearward end surface of the passive cam 6 and is fixed by a bolt 24. A force is applied to the lower end portion of the receiving plate 23 by a coil spring 26 which is positioned in a central cavity section 25 (see FIG. 3) of the guide base 7. A supporting pin 27 is positioned horizontally in the center of the cavity section 25, and its base end is fittingly joined with the supporting plate 17, and its other end is inserted into the supporting plate 18. The coil spring 26 is externally fitted to the supporting pin 27, and washer plates 28 are fitted onto the supporting pin 27 so as to intervene between the rearward end of the coil spring 26 and the front surface of the receiving plate 23.

FIG. 3 shows a state that the passive cam 6 is fitted into the guide base 7. The passive cam 6 is externally fitted onto the guide base 7. A vertical wear plate 31 and an oblique wear plate 32 are fixed to the inner surface of the passive cam 6 respectively by bolts 33 and 34. A vertical sliding surface 35 and an oblique sliding surface 36, which match with the vertical wear plate 31 and the oblique wear plate 32, are formed on the guide base 7. Even if the passive cam 6 is about to shift due to the forming process or the like, the passive cam 6 is fitted onto the guide base 7 so as to stretch thereover, and the vertical wear plate 31 of the passive cam 6 is guided on the vertical sliding surface 35 of the guide base 7. Therefore, the passive cam 6 does not shift, and thus a high-quality product can be processed.

Figure 4:
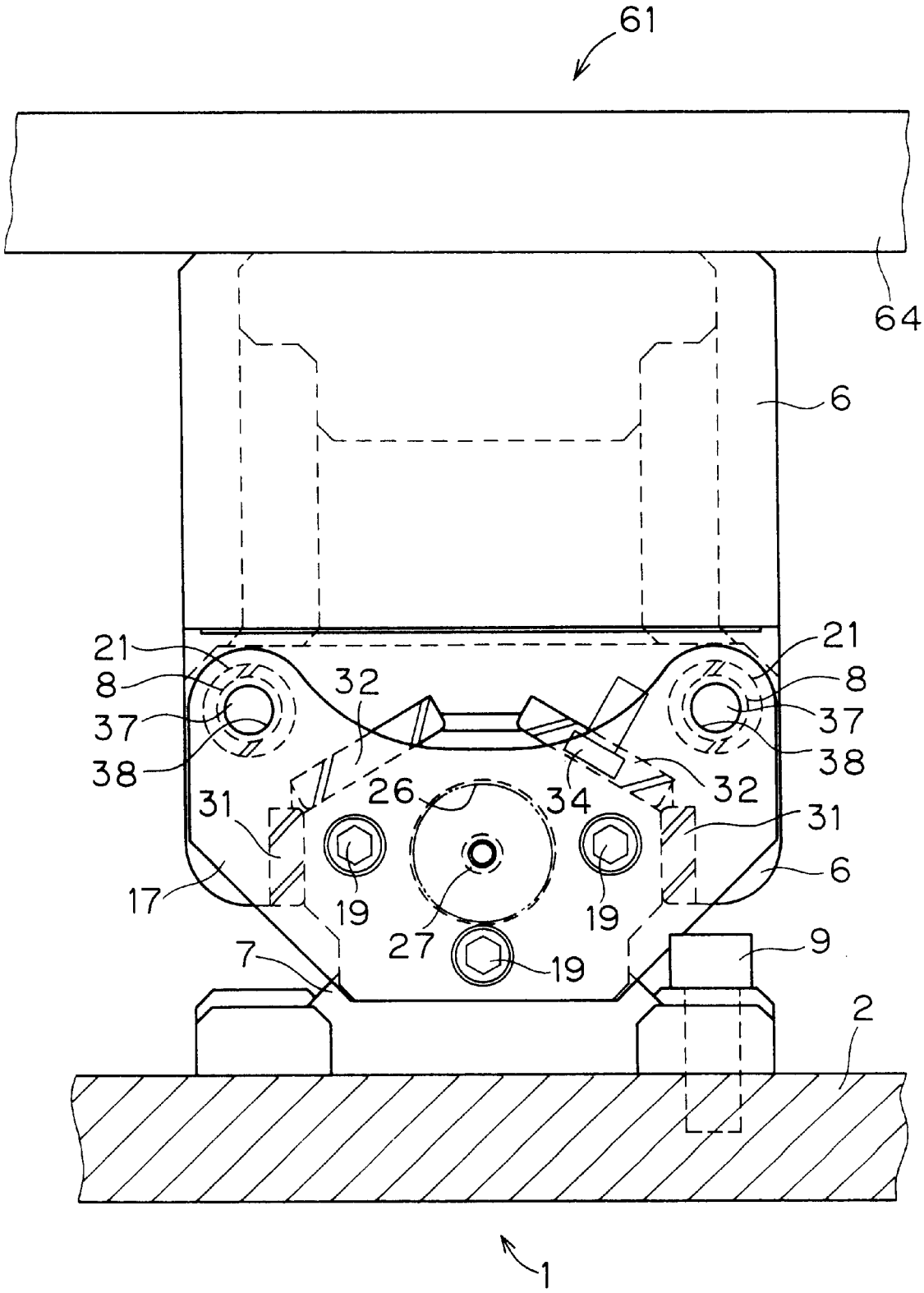
FIG. 4 is a front view taken along line IV—IV of FIG. 2.
Figure 5:
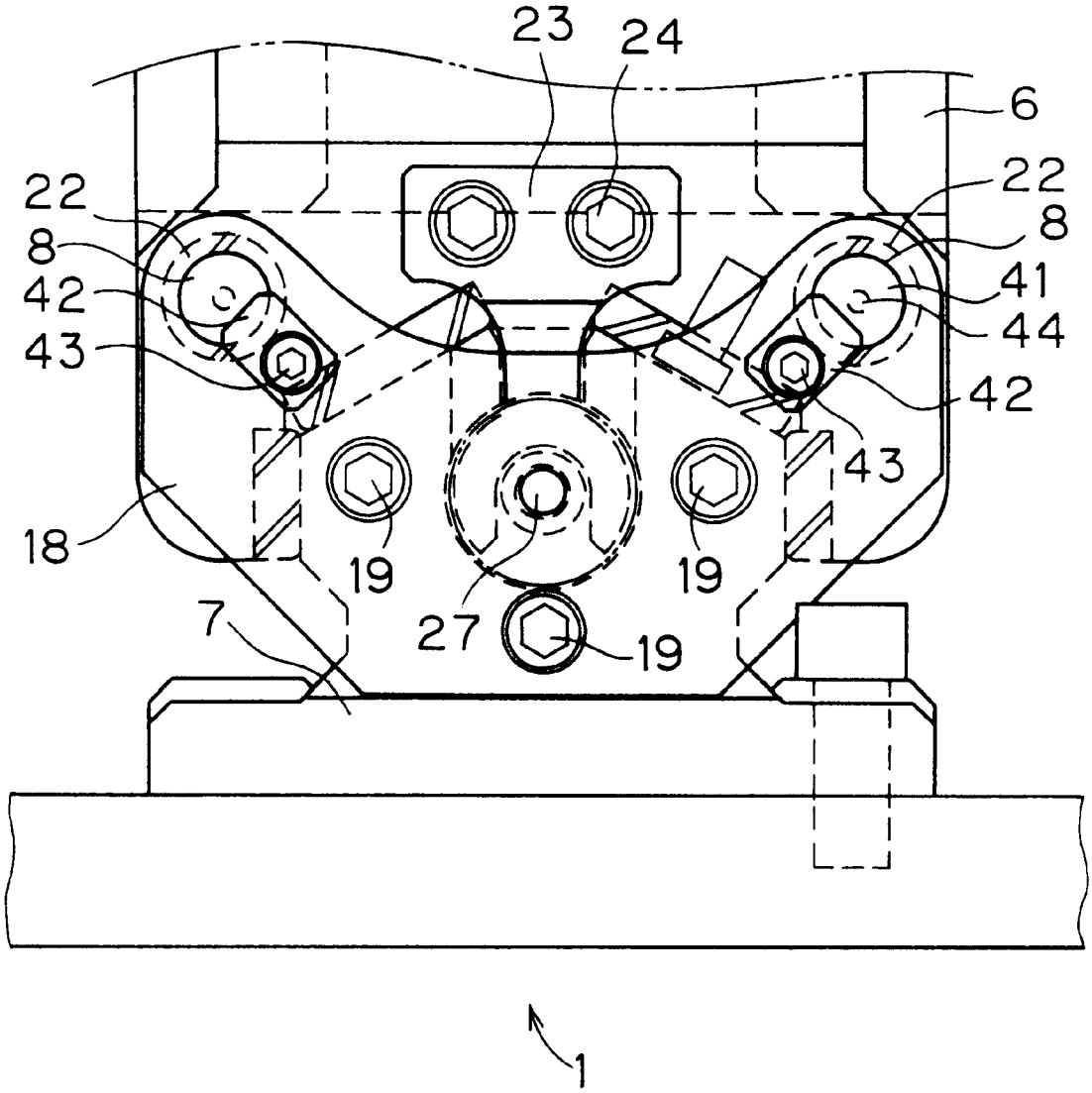
FIG. 5 is a back view taken along line V—V of FIG. 2.
Figure 6:
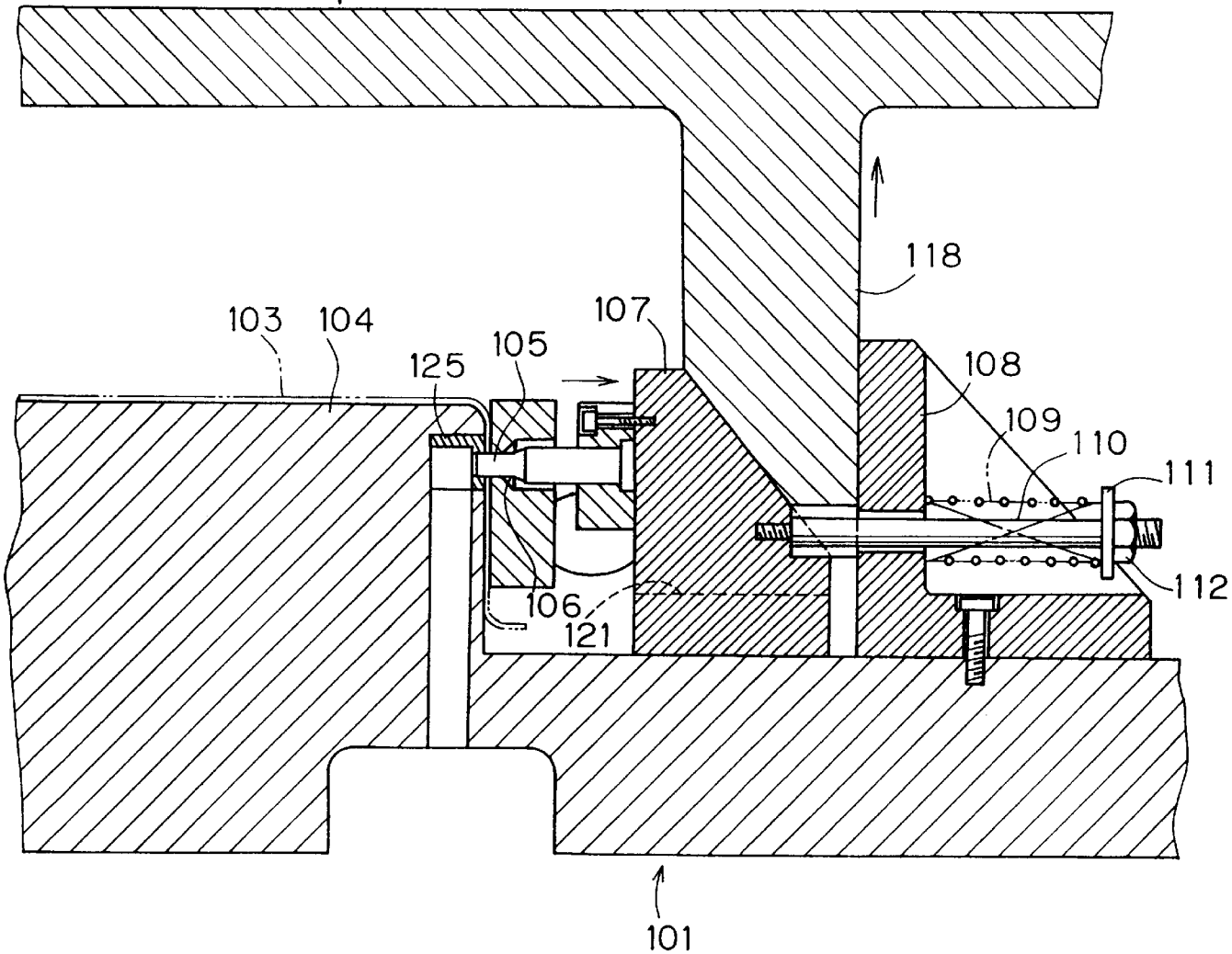
BACKGROUND ART FIG.6
FIG. 6 is a longitudinal section of a conventional press die.
Figure 7:
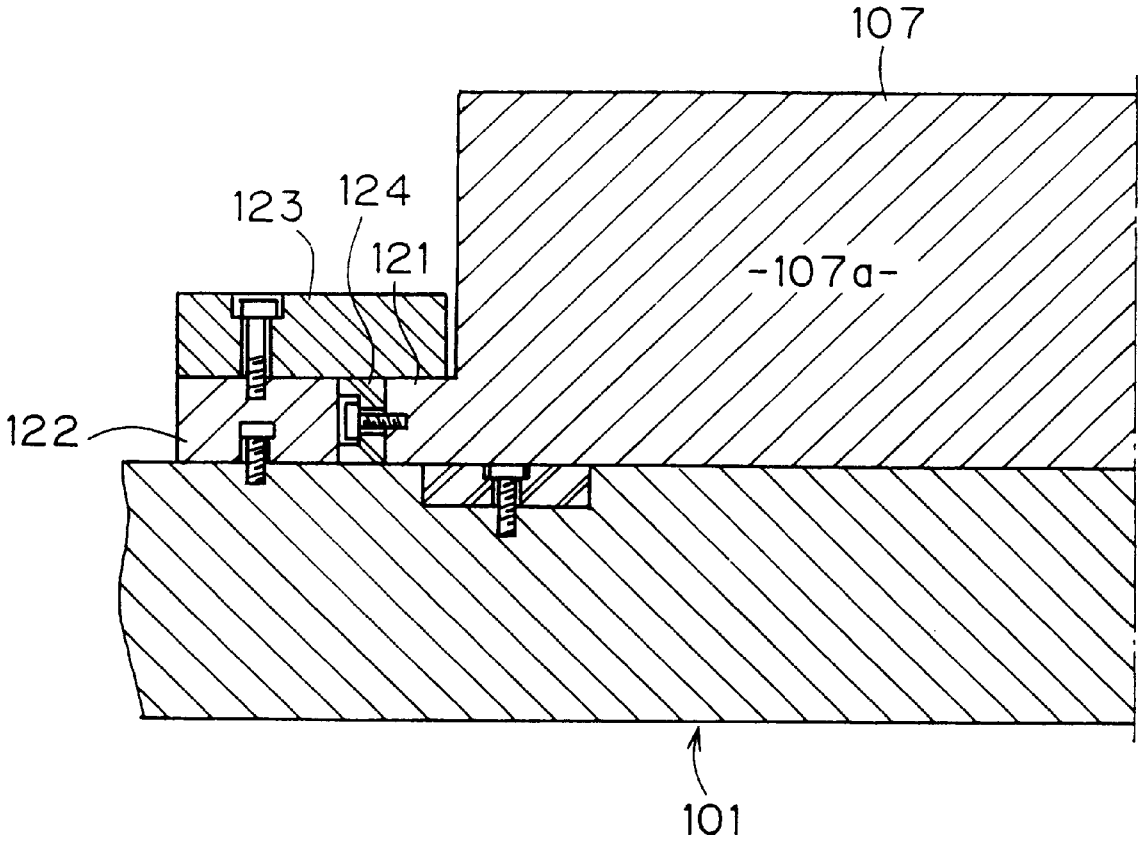
BACKGROUND ART FIG. 7
FIG. 7 is a sectional view showing a guide section of a passive cam in a conventional press apparatus.

In addition, as shown in FIGS. 4 and 5, since the passive cam 6 is slid by the two guide posts 8 having a circular section which are mounted across both the upper sides of the supporting plates 17 and 18, unstable sliding does not occur, namely, the passive cam 6 advances exactly, and thus accurate processing can be carried out.

Further, as shown in FIGS. 1 and 2, a base end small-diameter section 37 of the guide post 8 is fitted into a small-diameter hole 38 of the supporting plate 17, and a point section 39 of the guide post 8 is fitted into a supporting hole 40 of the supporting plate 17. A stop plate 42, which contacts with point surfaces 41 of the guide posts 8, is fixed to the rearward surface of the supporting plate 18 by a bolt 43 so that the guide posts 8 do not slip out of the supporting plates 17 and 18. When the cutting edge of the boring punch 5 is nicked and thus it should be repaired, the bolt 43 is released so that the stop plate 42 is removed, and a bolt is fitted into screw holes 44 which are located on the point surfaces 41 of the guide posts 8. Then, the guide posts 8 are moved rearwardly (the right direction in the drawing) so as to be drawn out. Since the small-diameter sections 37 of the guide posts 8 are simply fitted into the small-diameter holes 38, the guide posts 8 can be drawn out easily by moving them in the right direction.

After the guide posts 8 are removed from the passive cam 6 and the guide base 7, when the passive cam 6 is lifted up, as shown in FIG. 3, the passive cam 6 is guided on the vertical sliding surface 35 of the guide base 7 so as to easily move upward. As a result, the passive cam 6 can be dismounted, and the boring punch 5 or the like can be dismounted easily from the passive cam 6. Therefore, the repairing workability is improved.

A wear plate 51 is fixed to a slanted surface of the rearward surface of the passive cam 6 by a bolt 52.

In the upper die 61, a actuation cam 63, which contacts with the wear plate 51 on the rearward surface of the passive cam 6 in a lower die 1 and presses and drives the passive cam 6, is fixed to a substrate 64 by a bolt 65.

The following will describe an operation of this press apparatus.

First, as shown in FIG. 1, the work W is placed on the locating member 3 in the lower die 1.

Next, the upper die 61 is lowered. FIG. 1 shows a lowering state of the upper die 61.

The actuation cam 63 in the upper die 61 is brought into contact with the wear plate 51 of the passive cam 6 in the lower die 1 so as to drive the passive cam 6 towards the work W against the applied force of the coil spring 26. At this time, the passive cam 6 is guided by the guide posts 8 so as to advance straight without non-linear movement.

The work W is pressed by the stripper plate 14, and the boring punch 5 is fitted into the die 16 so as to bore a hole. FIG. 2 shows the upper die 61 in a bottom dead position.

When the boring process is completed, the upper die 61 starts to lift. The work W is pressed by the stripper plate 14 and the boring punch 5 moves rearwardly, and the passive cam 6 is also moved rearwardly by the applied force of the coil spring 26. The upper die 61 stops in a top dead center position.

When a nicked cutting edge of the boring punch 5 is to be repaired, the bolt 43 is released, and the stop plate 42 is removed. A bolt or the like is fitted into the screw holes 44 of the guide posts 8, and the guide posts 8 are drawn out rearwardly. At this time, since the guide posts 8 do not have a section whose diameter is larger than that of the supporting holes 40, they can be drawn out smoothly.

In addition, as is clear from FIG. 3, the coil spring 26 and the supporting pin 27 are positioned in the cavity section 25 of the guide base 7, and the passive cam 6 is externally fitted onto the guide base 7. For this reason, when the passive cam 6 is lifted up, it can be lifted up easily because of no interference, and the passive cam 6 is guided on the vertical sliding surface 35 of the guide base 7 so as to be able to be lifted up smoothly.

In addition, since the passive cam 6 is guided by the two guide posts 8 having a circular section, it advances straight without non-linear movement, and thus accurate processing can be carried out.

In addition, the guide posts 8 are provided across the nearest vicinity of the portion of the passive cam 6 where the processing member such as the boring punch 5 is mounted, and they are positioned on both sides of the processing member. As a result, processing accuracy can be improved as much as possible.

The above embodiment described the boring process, but needless to say, the present invention can be applied to other pressing processes such as a notching process and a forming process.

In addition, the above embodiment described an example where the coil spring is used as force applying means, but this means is not limited to this. Therefore, elastic materials such as rubber and urethane rubber or a gas spring may be used.

Further, in the above embodiment, the guide base is constituted so that the guide posts are mounted horizontally, but the guide posts can be slanted or inclined. In this case, the guide base requires a height higher than a certain value in order to make it possible to draw out the guide posts.

As mentioned above, a press apparatus has an actuation cam in an upper die, a passive cam in a lower die which is pressed and driven by the actuation cam and to which a processing member such as a punch is mounted, a guide base in the lower die for sliding and guiding the passive cam, guide posts which are mounted across the guide base and move so as to slide the passive cam, and force applying means for applying a force to the passive cam towards an opposite-work side. In such a press apparatus, the passive cam is fitted onto the guide base so that when the guide posts mounted across the guide base are drawn out, the passive cam is lifted up so as to be able to be dismounted. As a result, when the passive cam to which the processing member such as the punch was mounted is repaired, the passive cam can be removed easily from the lower die.

In addition, since the passive cam advances straight through the guide posts, the present invention can perform high-quality pressing process.

Further, since the passive cam is externally fitted into the guide base, the passive cam is lifted up so as to be able to be dismounted.

Furthermore, since the sliding surface of the passive cam and the guide base has a vertical surface, inclined weight is placed on the passive cam at the time of the forming process or the like, and thus the passive cam is apt to shift. However, the present invention eliminates this shift and can process a product into a desired shape.

In addition, when the passive cam is lifted up, the sliding surface serves as a guiding surface, and thus the passive cam can be lifted up smoothly.

Further, the guide posts are mounted across the nearest vicinity of a portion of the passive cam where the processing member such as the punch is mounted and are positioned on both the sides of processing member. Therefore, processing accuracy can be improved as much as possible.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A press apparatus comprising:

an actuation cam located in an upper die;

a passive cam located in a lower die which is contact-pressed and driven by the actuation cam and to which a processing member is mounted;

a guide base in the lower die for sliding and guiding the passive cam, said guide base including a main body member having a longitudinally-extending cavity section therein;

a first supporting plate located at a first end of said main body member of said guide base, said first supporting plate having small-diameter fitting holes therein;

a second supporting plate located at a second end of said main body member of said guide base, said second supporting plate having supporting holes therein;

guide posts which are mounted across the guide base, each of said guide posts having a first end portion fitted into a respective one of said small-diameter fitting holes and a second end portion fitted into a respective one of said supporting holes, said guide posts being laterally spaced apart from one another and on opposite sides of said cavity section of said main body member;

guide apertures located in said passive cam, said guide apertures slidably receiving said guide posts therein so that the passive cam is slidable on the guide posts; and a force applying device located in said cavity section of said main body portion for applying a biasing force to the passive cam, the passive cam advancing along a straight line along the guide posts, the passive cam being externally fitted into the guide base, and a sliding surface of the passive cam and the guide base having a vertical surface, the passive cam being fitted into the guide base so that when the guide posts mounted across the guide base are withdrawn from said small-diameter fitting holes and said guide apertures, the passive cam can be vertically lifted and dismounted from the guide base.

2. The press apparatus according to claim 1, further comprising:

a pair of spaced-apart first slide surfaces located on said main body member of said guide base which comprise a V-shaped surface;

a pair of spaced-apart second slide surfaces located on said main body member of said guide base outwardly of said first slide surfaces, said second slide surfaces being vertically oriented;

a pair of first sliding surfaces located on said passive cam which comprise a V-shaped surface mutually compatible with said V-shaped surface of said guide base;

a pair of second sliding surfaces located on said passive cam outwardly of said first sliding surfaces, said second sliding surfaces being vertically oriented, said second sliding surfaces of said passive cam being slidably engaged with said second slide surfaces of said guide base; and a supporting pin extending at least partially into said cavity section of said main body member, said supporting pin having a first end portion supported by said first supporting plate, and a second end portion supported by said second supporting plate, wherein said force applying device comprises a coil spring surrounding said supporting pin.

3. A press apparatus comprising:

an actuation cam located in an upper die;

a passive cam located in a lower die which is contact-pressed and driven by the actuation cam and to which a processing member is mounted;

a guide base in the lower die for sliding and guiding the passive cam, said guide base including a main body member having a longitudinally-extending cavity section therein;

a first supporting plate located at a first end of said main body member of said guide base, said first supporting plate having small-diameter fitting holes therein;

a second supporting plate located at a second end of said main body member of said guide base, said second supporting plate having supporting holes therein;

guide posts which are mounted across the guide base, each of said guide posts having a first end portion fitted into a respective one of said small-diameter fitting holes and a second end portion fitted into a respective one of said supporting holes, said guide posts being laterally spaced apart from one another and on opposite sides of said cavity section of said main body member;

guide apertures located in said passive cam, said guide apertures slidably receiving said guide posts therein so that the passive cam is slidable on the guide posts; and a force applying device located in said cavity section of said main body portion for applying a biasing force to the passive cam, the passive cam advancing along a straight line along the guide posts, the passive cam being externally fitted into the guide base, and a sliding surface of the passive cam and the guide base having a vertical surface, wherein the guide posts are mounted across the nearest vicinity of a portion of the passive cam where the processing member is mounted and are positioned on both sides of the processing member, whereby the passive cam is removable from the guide base by withdrawing the guide posts from said small-diameter fitting holes and said guide apertures, and vertically lifting the passive cam from the guide base.

4. The press apparatus according to claim 3, further comprising:

a pair of spaced-apart first slide surfaces located on said main body member of said guide base which comprise a V-shaped surface;

a pair of spaced-apart second slide surfaces located on said main body member of said guide base outwardly of said first slide surfaces, said second slide surfaces being vertically oriented;

a pair of first sliding surfaces located on said passive cam which comprise a V-shaped surface mutually compatible with said V-shaped surface of said guide base;

a pair of second sliding surfaces located on said passive cam outwardly of said first sliding surfaces, said second sliding surfaces being vertically oriented, said second sliding surfaces of said passive cam being slidably engaged with said second slide surfaces of said guide base; and a supporting pin extending at least partially into said cavity section of said main body member, said supporting pin having a first end portion supported by said first supporting plate, and a second end portion supported by said second supporting plate, wherein said force applying device comprises a coil spring surrounding said supporting pin.

5. A press device comprising:

a guide base including:

a main body member having a longitudinally-extending cavity section therein;

a first supporting plate located at a first end of said main body member;

a second supporting plate located at a second end of said main body member;

a first guide rod having a first end portion supported by said first supporting plate and a second end portion supported by said second supporting plate; and a second guide rod having a first end portion supported by said first supporting plate and a second end portion supported by said second supporting plate, said first guide rod and said second guide rod being laterally spaced apart from one another and on opposite sides of said cavity section of said main body member;

a passive cam including:

a first guide aperture located in said passive cam, said first guide aperture slidably receiving said first guide rod therein; and a second guide aperture located in said passive cam, said second guide aperture slidably receiving said second guide rod therein; and a biasing member provided in said cavity section of said main body portion and extending between said passive cam and said guide base.

6. The press device according to claim 5, wherein said guide base further comprises a second guide rod, and said passive cam further comprises a second guide aperture, said second guide aperture slidably receiving said second guide rod therein.

7. The press device according to claim 5, wherein said first guide aperture is a circular bore, and said first guide rod is a circular rod.

8. The press device according to claim 5, wherein said biasing member is a coil spring.

9. The press device according to claim 5, wherein said passive cam includes a machining tool mounted thereto.

10. The press device according to claim 5, further comprising an actuation cam including an inclined driving surface, said passive cam further comprising an inclined driven surface slidably engagable by said inclined driving surface of said actuation cam.

11. The press device according to claim 10, further comprising an upper displaceable die plate and an opposing lower die plate, said upper and lower die plates being parallel to each other, said actuation cam being fixed to said upper die plate and movable therewith, said guide base being fixed to said lower die plate.

12. The press device according to claim 11, further comprising a workpiece support mounted on said lower die plate.

13. The press device according to claim 11, wherein said first and second guide apertures are circular bores, and said first and second guide rods are circular rods.

14. The press device according to claim 11, further comprising a workpiece support mounted on said lower die plate, and wherein said passive cam includes a machining tool mounted thereon.

15. The press device according to claim 5, further comprising:

a pair of spaced-apart first slide surfaces located on said main body member of said guide base which comprise a V-shaped surface;

a pair of spaced-apart second slide surfaces located on said main body member of said guide base outwardly of said first slide surfaces, said second slide surfaces being vertically oriented;

a pair of first sliding surfaces located on said passive cam which comprise a V-shaped surface mutually compatible with said V-shaped surface of said guide base; and a pair of second sliding surfaces located on said passive cam outwardly of said first sliding surfaces, said second sliding surfaces being vertically oriented, said second sliding surfaces of said passive cam being slidably engaged with said second slide surfaces of said guide base.

16. The press device according to claim 5, further comprising a supporting pin extending at least partially into said cavity section of said main body member, said supporting pin having a first end portion supported by one of said first supporting plate and said second supporting plate.

17. The press device according to claim 16, wherein said first end portion of said supporting pin is supported by said first supporting plate, and said supporting pin includes a second end portion supported by said second supporting plate.

18. The press device according to claim 16, wherein said biasing member comprises a coil spring at least partially surrounding said supporting pin.

19. The press device according to claim 5, further comprising:

a pair of small-diameter fitting holes located in said first supporting plate; and a pair of supporting holes located in said second supporting plate;

said first end portions of said first guide rod and said second guide rod being fitted into said pair of small-diameter fitting holes, and said second end portions of said first guide rod and said second guide rod being fitted into said pair of supporting holes.

20. The press device according to claim 5, wherein said first guide rod and said second guide rod are free of biasing members therearound.

* * * * *